US009689060B2

(12) United States Patent
Murakami et al.

(10) Patent No.: US 9,689,060 B2
(45) Date of Patent: Jun. 27, 2017

(54) HIGH-STRENGTH HOT-ROLLED STEEL SHEET

(75) Inventors: Toshio Murakami, Kobe (JP); Masao Kinefuchi, Kobe (JP); Hideo Hata, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 39 days.

(21) Appl. No.: 14/237,286

(22) PCT Filed: Aug. 15, 2012

(86) PCT No.: PCT/JP2012/070727

§ 371 (c)(1),
(2), (4) Date: Feb. 5, 2014

(87) PCT Pub. No.: WO2013/024860

PCT Pub. Date: Feb. 21, 2013

(65) Prior Publication Data

US 2014/0161659 A1 Jun. 12, 2014

(30) Foreign Application Priority Data

Aug. 17, 2011 (JP) ..... 2011-178475
Aug. 17, 2011 (JP) ..... 2011-178476

(51) Int. Cl.
*C22C 38/28* (2006.01)
*C21D 8/02* (2006.01)
(Continued)

(52) U.S. Cl.
CPC ..... *C22C 38/28* (2013.01); *C21D 8/0226* (2013.01); *C21D 9/46* (2013.01); *C22C 38/001* (2013.01);
(Continued)

(58) Field of Classification Search
CPC ..... C22C 38/001; C22C 38/02; C22C 38/04; C22C 38/06; C22C 38/08; C22C 38/12;
(Continued)

(56) References Cited

U.S. PATENT DOCUMENTS 6,290,784 B1 * 9/2001 Yasuhara et al. ..... 148/320
6,666,932 B2 * 12/2003 Funakawa et al. ..... 148/328
(Continued)

FOREIGN PATENT DOCUMENTS

EP 0 997 548 A1 5/2000
EP 1 790 737 A1 5/2007
(Continued)

OTHER PUBLICATIONS

International Search Report Issued Nov. 20, 2012 in PCT/JP12/070727 Filed Aug. 15, 2012.
(Continued)

*Primary Examiner* — Jessee Roe
*Assistant Examiner* — John Hevey
(74) *Attorney, Agent, or Firm* — Oblon, McClelland, Maier & Neustadt, L.L.P.

(57) ABSTRACT

This high-strength hot-rolled steel plate contains specific amounts of C, Si, Mn, Al, V and also Ti and/or Nb so as to fulfill C−12(V/51+Ti/48+Nb/93)>0.03, and the rest consists of iron and unavoidable impurities. Ferrite is the main microstructure, the remaining microstructure is one or more selected from the group consisting of bainite, martensite and retained austenite, wherein the average particle diameter of precipitated carbides (the total content of V, Ti and Nb is 0.02% or greater) in the ferrite is less than 6 nm.

8 Claims, 1 Drawing Sheet

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/08*** | (2006.01) |
| ***C22C 38/16*** | (2006.01) |
| ***C22C 38/24*** | (2006.01) |

(52) U.S. Cl.
CPC ..... *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/24* (2013.01); *C21D 2211/002* (2013.01); *C21D 2211/004* (2013.01); *C21D 2211/005* (2013.01)

(58) Field of Classification Search
CPC ..... C22C 38/14; C22C 38/16; C22C 38/24; C22C 38/28; C21D 2211/002; C21D 2211/004; C21D 2211/005
USPC ..... 420/93, 104, 118, 119, 120, 124, 127; 3/93, 104, 118, 119, 120, 124, 127
See application file for complete search history.

(56) References Cited

U.S. PATENT DOCUMENTS 7,749,338 B2 * 7/2010 Yokoi ..... C22C 38/001 148/320
2005/0106411 A1 * 5/2005 Ishikawa ..... C21D 8/0226 428/683
2011/0030854 A1 * 2/2011 Matsuda et al. ..... 148/504
2012/0040203 A1 * 2/2012 Takagi ..... C21D 8/0405 428/577
2012/0305144 A1 * 12/2012 Okamoto ..... C21D 9/46 148/533

FOREIGN PATENT DOCUMENTS

| | | |
|---|---|---|
| EP | 2 436 797 A1 | 4/2012 |
| JP | 09 067643 | 3/1997 |
| JP | 09 137249 | 5/1997 |
| JP | 11 189842 | 7/1999 |
| JP | 2003-321738 A | 11/2003 |
| JP | 2007 321201 | 12/2007 |
| JP | 2008 133514 | 6/2008 |
| JP | 2009 84648 | 4/2009 |
| JP | 2009 191360 | 8/2009 |
| JP | 2009 275238 | 11/2009 |
| JP | 2009 293067 | 12/2009 |
| JP | 2011 38154 | 2/2011 |
| JP | 2011 122188 | 6/2011 |
| JP | 4772927 | 7/2011 |

OTHER PUBLICATIONS

Written Opinion of the International Searching Authority Issued Nov. 20, 2012 in PCT/JP12/070727 Filed Aug. 15, 2012.
Extended European Search Report issued Jun. 17, 2015 in Patent Application No. 12824032.2.

* cited by examiner

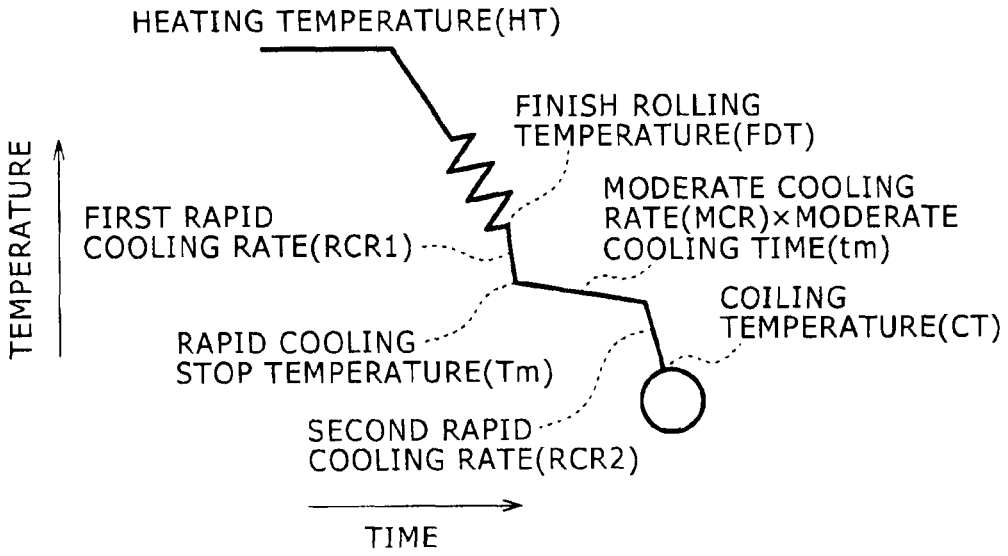
HEATING TEMPERATURE(HT)
FINISH ROLLING TEMPERATURE(FDT)
MODERATE COOLING RATE(MCR)×MODERATE COOLING TIME(tm)
FIRST RAPID COOLING RATE(RCR1)
COILING TEMPERATURE(CT)
RAPID COOLING STOP TEMPERATURE(Tm)
SECOND RAPID COOLING RATE(RCR2)
TEMPERATURE
TIME

HIGH-STRENGTH HOT-ROLLED STEEL SHEET

TECHNICAL FIELD

The present invention relates to a high-strength hot-rolled steel sheet. More particularly, it relates to a high-strength hot-rolled steel sheet for use in components requiring strength, workability, and fatigue property such as automotive suspension and frame components.

BACKGROUND ART

In recent years, steel sheets made available for automotive components have been improved in strength in order to implement the crash safety and the fuel economy improvement. The automotive suspension components and frame components, and the like have also been improved in strength. However, the weight reduction of components requires the improvement of the fatigue strength as well as the static strength. Further, working into a complicated shape requires the compatibility with the workability (ductility or stretch flange formability).

It is known as follows: it is effective for the improvement of the workability that a DP steel including two kinds of microstructures having a large strength ratio is adopted; and further, as the method for improving the fatigue property of the DP steel, it is effective to harden the ferrite part low in strength and susceptible to a stress concentration. For example, Patent literature 1 describes as follows: in a DP steel including a main phase ferrite which has undergone precipitation hardening with a Ti or Nb carbide, and a hard second phase, the average ferrite particle size of the surface layer part to 20 μm is set at 5 μm or less. Patent literature 2 describes as follows: in a DP steel including a second phase including martensite/acicular ferrite/retained austenite, proeutectoid ferrite is subjected to precipitation hardening, thereby to improve the strength-workability-fatigue property.

For the hot-rolled steel sheets described in the Patent literatures 1 and 2, the holding/retention time at around 700 to 800° C. is set short, and Ti and Nb carbide particles are precipitated in a dispersed state in ferrite, thereby to precipitation harden the main phase ferrite. It is considered as follows: in the hot-rolled steel sheet, the precipitate precipitated finely in a dispersed state with holding/retention in a short time within the temperature range acts as an obstacle against the repeating motion of dislocation, thereby to improve the fatigue property. However, in the related-art technology, this cannot be said to produce a sufficient fatigue property improving effect.

Under such circumstances, with an aim to further improve the fatigue property of a DP steel, the present inventors conducted a close research and development on the precipitation hardening of ferrite in a DP steel. As a result, the following fact was found: when, in a DP steel, ferrite is hardened by precipitates of Ti, Nb, V, and the like, the holding/retention time within the temperature range is increased, thereby to appropriately coarsen the precipitates; this can produce a high fatigue property improving effect. Based on this finding, the following high-strength hot-rolled steel sheet was completed, and has already been filed for patent (see Patent literature 3).

The high-strength cold-rolled steel sheet proposed by the present inventors in Patent literature 3 (which will be hereinafter referred to as a "prior invention steel sheet") is, a high-strength hot-rolled steel sheet excellent in strength-elongation balance and fatigue property which includes, by mass %, C: more than 0.01% and 0.30% or less, Si: 0.1% or more and 2.0% or less, and Mn: 0.1% or more and 2.5% or less, and includes one, or two or more of V: 0.01% or more and 0.15% or less, Nb: 0.02% or more and 0.30% or less, and Ti: 0.01% or more and 0.15% or less so as to satisfy the following conditional expression (1), and the balance including Fe and inevitable impurities, and which has a microstructure having a ferrite fraction of 50% or more and 95% or less, and a hard second phase fraction including martensite+retained austenite of 5% or more and 50% or less, wherein the average particle size r of precipitates formed in the ferrite is 6 nm or more, and the average particle size r and the precipitate fraction f expressed by the following expression (2) satisfy the following conditional expression (3).

$$C-12\times(V/51+Nb/93+Ti/48)\geq 0.01 \quad (1)$$

$$f=(2.08Ti+1.69V+1.14Nb)/100 \quad (2)$$

$$r/f\leq 13000 \quad (3)$$

Herein, each symbol of element in the expressions (1) and (2) means the mass % of the element.

The prior invention steel sheet is excellent in workability and fatigue property. However, the automotive components after working are often joined by welding to the car body, other members, or the like to be used. It is known as follows: in such a case, the heat affected zone (which will be also hereinafter referred to as "HAZ") is more reduced in fatigue strength than the base material. For this reason, when automotive components are welded and joined to be used, a mere improvement of the fatigue property of the base material is not enough, and it is important to improve even the fatigue property of the HAZ. The prior invention steel sheet produces an excellent effect on the improvement of the fatigue property of the base material. However, there is a room for improvement of the fatigue property of the HAZ.

On the other hand, as the method for improving the fatigue property of the HAZ of the hot-rolled steel sheet, there is disclosed the following welding method: for welding, welding is performed after preheating the top of the welding line to 350 to 500° C.; as a result, HAZ is caused to include retained austenite, so that the fatigue property of the HAZ is improved (see Patent literature 4). However, this method requires the pre-heating operation before welding, and hence is unfavorably inferior in operability of the welding procedure.

CITATION LIST

Patent Literature

[Patent literature 1] JP-A No. H9 (1997)-137249
[Patent literature 2] JP-A No. H11 (1999)-189842
[Patent literature 3] JP-A No. 2007-321201
[Patent literature 4] JP-A No. H9 (1997)-67643

SUMMARY OF INVENTION

Technical Problem

The present invention was completed in view of the foregoing circumstances. It is an object thereof to provide a high-strength hot-rolled steel sheet which is excellent in formability (workability), and can be improved in fatigue property not only at the base material but also at the HAZ.

The present invention steel sheet embraces a steel including a ferrite microstructure as the main body, and the balance including one or more microstructures selected from the group consisting of bainite, martensite, and retained austenite. As with the prior invention steel sheet, precipitated carbides of V, Ti, Nb, and the like are allowed to be present in a prescribed amount in ferrite. This hardens the base material microstructure, thereby to improve the fatigue property of the base material. Meanwhile, contrary to the prior invention steel sheet, the precipitated carbides are refined, so that V and C derived from V carbide (VC) are incorporated in solid solution in the matrix during heating by welding. This inhibits the refinement of austenite particles, and enhances the quenching property of the matrix. As a result, during cooling after welding, ferrite and upper bainite are inhibited from being formed, thereby to promote the formation of martensite or bainite. At the same time, the solute C content of the martensite or the bainite is increased, which can also improve the strength of the martensite or the bainite itself, and can improve even the fatigue strength of the HAZ.

Namely, the steel sheet of the present invention is a high-strength hot-rolled steel sheet, having a composition including, by mass % (the same applies to the following for the chemical components.)

C: 0.05 to 0.20%, Si: 2.0% or less, Mn: 1.0 to 2.5%, Al: 0.001 to 0.10%, and V: 0.0005 to 0.10%, and further including Ti: 0.02 to 0.20% and/or Nb: 0.02 to 0.20% so as to satisfy the following expression 1, and the balance including iron and inevitable impurities, and having a microstructure including, by area ratio based on the total microstructure (the same applies to the following for the microstructure.)

ferrite: 50 to 95%, and the balance including one or more microstructures selected from the group consisting of bainite, martensite, and retained austenite.

The average particle size of precipitated carbides present in the ferrite is less than 6 nm, and the total content of V, Ti, and Nb forming the precipitated carbides is 0.02% or more:

$$C-12\times(V/51+Ti/48+Nb/93)>0.03 \quad \text{Expression 1:}$$

where the symbol of element in the expression means mass %.

The steel sheet of the present invention can be configured such that the microstructure in the steel has a microstructure including, by area ratio based on the total microstructure, ferrite: 50 to 90%, bainite: 10 to 50%, and martensite+retained austenite: less than 10%.

Alternatively, the steel sheet of the present invention can be configured such that the microstructure in the steel has, by area ratio based on the total microstructure, ferrite: 50 to 90%, and the balance including martensite+retained austenite.

It is preferable that the average particle size of the bainite is more than 5 μm. It is preferable that the average particle size of the martensite+retained austenite is more than 5 μm.

The steel sheet of the present invention is preferably configured such that the composition further includes one or more of Cu: 0.01 to 1.0%, Ni: 0.01 to 1.0%, Cr: 0.01 to 1.0%, and Mo: 0.01 to 1.0%.

In accordance with the present invention, it is possible to provide a high-strength hot-rolled steel sheet excellent in both the fatigue properties of the base material and the HAZ while ensuring the formability.

BRIEF DESCRIPTION OF DRAWINGS

The FIGURE is a view illustrating the process of an example.

DESCRIPTION OF EMBODIMENTS

As described above, the present inventors continued a study on the following method: with a steel including ferrite hardened by precipitated carbides as a base, even the fatigue property of the HAZ is improved while ensuring the formability and the fatigue property of the base material.

Herein, the HAZ is formed in the vicinity of the weld metal. The form of the microstructure is divided into three regions of a coarse grain region, a fine grain region, and a dual phase region or a tempered region, sequentially from the side closer to the weld metal. Then, in the related-art steel, it is generally known that the characteristics of respective regions of the HAZ show the following behaviors. Namely, in the coarse grain region, austenite particles are coarsened during heating by welding. Accordingly, during cooling after welding, transformation into martensite or bainite is caused, generally resulting in high strength. In contrast, in the fine grain region, at the time of heating by welding, austenite particles are refined. Accordingly, during cooling after welding, ferrite or upper bainite becomes more likely to be formed, resulting in the reduction of the strength, and becomes a starting point of fatigue failure. Whereas, in the dual phase region or the tempered region, the strength is reduced by tempering, and the fatigue strength is also reduced.

Under such circumstances, the present inventors first proposed the dispersion of fine precipitated carbides in ferrite as the first method for improving the fatigue property of the HAZ. As a result of this, in the dual phase region or the tempered region, ferrite is hardened, and acts toward the improvement of the fatigue property. However, in the coarse grain region and the fine grain region, the pinning action of the precipitated carbides causes refinement of austenite particles. This promotes the formation of ferrite and the upper bainite, so that the amount of martensite formed is insufficient. Further, the precipitated carbides fix carbon. For this reason, the solute C content in martensite is reduced, which acts in the direction of rather deteriorating the fatigue property.

By taking the related-art (Ti+Nb) doped steel as an example, a more specific description will be given. In the (Ti+Nb) doped steel, during hot rolling, austenite particles are coarse, and the transformation start point is on the long time side. However, the cooling rate upon hot rolling is small, and hence the ferrite transformation can be promoted. This enables the transformation into ferrite+bainite, or transformation into ferrite+martensite (so-called transformation into DP). However, during heating by welding, in the region corresponding to the coarse grain region and the fine grain region of the HAZ, the pinning action of (Ti, Nb)C refines austenite particles, and Ti and Nb fix C. For this reason, the solute C content in austenite is reduced, and the transformation start point shifts to the short time side. Accordingly, during cooling after welding, ferrite transformation and upper bainite transformation tend to occur even when the cooling rate is high. Whereas, even when martensite is formed across the bainite nose, the martensite strength proportional to the solute C content is reduced. Accordingly, it is not possible to ensure the fatigue property.

Therefore, it has been determined that mere dispersion of fine precipitated carbides in ferrite cannot improve the fatigue property of the HAZ surely and sufficiently.

Under such circumstances, as the second method for improving the fatigue property of the HAZ surely and sufficiently, the present inventors proposed the following: a V carbide (VC) having a low melting point of the precipitated carbides is partially incorporated in solid solution during heating by welding; this establishes the compatibility between the precipitation hardening of the base material and the quenching property of the coarse grain region and the fine grain region of the HAZ.

More specifically, the present inventors considered as follows: for the (Ti+Nb) doped steel, (Ti+Nb) are partially replaced with V; thus, following the microstructure formation behavior during hot rolling, the base material microstructure is kept as it is, meanwhile, the fatigue property of the HAZ can be improved by utilizing the following mechanism.

Namely, in the region corresponding to the coarse grain region and the fine grain region of the HAZ, during heating by welding, the portion of VC of [Ti, Nb, V]C which are precipitated carbides is partially incorporated in solid solution, resulting in the reduction of the refinement action of austenite particles. Further, incorporation of V, C in solid solution into austenite enhances the quenching property. Thus, the transformation start point shifts to the long time side. Accordingly, the formation of ferrite or upper bainite during cooling after welding is inhibited, and the amount of martensite formed is ensured. Further, the increase in solute C content also results in the improvement of the strength of martensite itself. Thus, the strength of martensite itself is improved, and the amount of martensite formed is ensured. This leads to the improvement of the fatigue properties of the coarse grain region and the fine grain region of the HAZ.

Incidentally, in order to implement the sure and sufficient improvement of the fatigue property of the HAZ by the mechanism, it is necessary to promote the incorporation of VC in solid solution in the precipitated carbides. To that end, the precipitated carbides are required to be refined so as to be smaller than a prescribed size.

Then, a further study such as execution of a verification test is further pursued based on the idea. As a result, the present invention was completed.

Below, first, a description will be given to the microstructure characterizing the steel sheet of the present invention.

[Microstructure of the Present Invention Steel Sheet]

As described above, the present invention steel sheet includes a steel including ferrite as the main body as a base. Particularly, the present invention steel is different from the prior invention steel sheet in the following point: the average particle size of the precipitated carbides present in ferrite is limited to 6 nm or more for the prior invention steel sheet, but is limited to less than 6 nm for the present invention steel sheet.

<Microstructure Including Ferrite: 50 to 95%, and One or More Microstructures Selected from the Group Consisting of the Balance Including Bainite, Martensite, and Retained Austenite>

When ferrite is in an amount of less than 50%, namely, other phases than ferrite are in an amount of more than 50%, other phases than ferrite are combined with each other. As a result, the elongation EL cannot be ensured. On the other hand, when ferrite is in an amount of more than 95%, namely, other phases than ferrite are in an amount of less than 5%, the tensile strength TS cannot be ensured.

Herein, in accordance with one preferable aspect, the present invention steel sheet has a microstructure including ferrite: 50 to 90%, bainite: 10 to 50%, and martensite+retained austenite: less than 10%. By adopting such a microstructure, it is also possible to ensure the stretch flange formability λ. As the microstructures other than ferrite which is the main phase and bainite, martensite+retained austenite (MA) are included in an amount of less than 10%. This is in order to prevent the balance among strength-elongation-stretch flange formability from being reduced due to the presence of a still harder microstructure.

More preferably, the microstructure includes ferrite: 60 to 80%, and bainite: 20 to 40%.

Alternatively, in accordance with another preferable one aspect, the present invention steel sheet has a microstructure including ferrite: 50 to 90%, and the balance: martensite+retained austenite. By adopting such a microstructure, the balance between the tensile strength TS and the elongation EL is further improved. Incidentally, for describing the present invention steel sheet having such a microstructure, the microstructure of martensite+retained austenite may be referred to as a hard second phase.

<Average Particle Size of Precipitated Carbides Present in Ferrite: Less than 6 nm>

Refinement of precipitated carbides promotes the incorporation of VC in solid solution in precipitated carbides. This is in order to implement a sure and sufficient improvement of the fatigue property of the HAZ by the mechanism. Preferably, the average particle size is 5 nm or less, and further preferably 4 nm or less.

Incidentally, for the prior invention steel sheet, the value is restricted to 6 nm or more, thereby to improve the fatigue property of the base material. However, for the present invention steel sheet, while sacrificing the degree of improvement of the fatigue strength of the base material, the fatigue property of the HAZ is improved. As a result, it is possible to improve the fatigue strengths of both the base material and the HAZ in a good balance.

<Total Content of Ti, Nb, and V Forming Precipitated Carbides: 0.02% or More>

The total content of alloy elements of carbides contributing to precipitation hardening is restricted. It is said that the degree of precipitation hardening is proportional to f/r (where f: precipitated carbide fraction, and r: precipitated carbide particle size). For this reason, an increase in the parameter corresponding to the precipitated carbide fraction f results in an improvement of the fatigue strength. Preferably, the total content is 0.03% or more, and further preferably 0.05% or more.

<Average Particle Size of Bainite: More than 5 μm>

When the microstructure of the present invention steel sheet includes ferrite: 50 to 90%, bainite: 10 to 50%, and martensite+retained austenite: less than 10%, the average particle size of bainite is desirably coarsened to more than 5 μm. As a result, while somewhat sacrificing the balance among strength-elongation-stretch flange formability of the base material, the bainite region including no carbide precipitated is increased in size for the HAZ. Thus, during heating by welding, austenite particles are coarsened, and the quenching property is enhanced. As a result, ferrite and the upper bainite are inhibited from being formed, thereby to improve the fatigue property. More preferably, the average particle size is 8 μm or more.

<Average Particle Size of Martensite+Retained Austenite: More than 5 μm>

When the microstructure of the present invention steel sheet includes ferrite: 50 to 90% and the balance: martensite+retained austenite (hard second phase), the average particle size of the hard second phase is desirably coarsened to more than 5 μm. As a result, while sacrificing the balance between strength-ductility of the base material, the martensite region including no carbide precipitated is increased in size for the HAZ. Thus, during heating by welding, austenite particles are coarsened, and the quenching property is enhanced. As a result, ferrite and the upper bainite are inhibited from being formed, thereby to improve the fatigue property. More preferably, the average particle size is 8 μm or more.

[Respective Measuring Methods of Area Ratio of Each Phase, the Average Particle Size of Precipitated Carbide Present in Ferrite, the Total Content of Ti, Nb, and V Forming the Precipitated Carbides, and the Average Particle Size of Bainite and the Hard Second Phase]

Herein, a description will be given to respective measuring methods of the area ratio of each phase, the total content of Ti, Nb, and V forming the precipitated carbides present in ferrite, and the average particle size of bainite and the hard second phase.

When the microstructure of the present invention steel sheet includes ferrite: 50 to 90%, bainite: 10 to 50%, martensite+retained austenite: less than 10%, the area ratio of each phase of the microstructure in the steel sheet was measured in the following manner: each sample steel sheet is subjected to nital corrosion, and five visual fields are photographed under a scanning electron microscope (SEM; magnification 1000 times), thereby to determine respective ratios of ferrite, bainite, pearlite, and martensite+retained austenite by a point counting method.

When the microstructure of the steel sheet of the present invention includes ferrite: 50 to 90% and the balance: martensite+retained austenite (hard second phase), first, the area ratio of the hard second phase of the microstructure in the steel sheet was measured in the following manner: a steel sheet is subjected to Lepera corrosion, and a white region is identified as a hard second phase (martensite+retained austenite) by transmission electron microscope (TEM; magnification 1500 times) observation, thereby to measure the area ratio.

Then, the area ratio of ferrite was measured in the following manner: each sample steel sheet is subjected to nital corrosion, and by scanning electron microscope (SEM; magnification 2000 times) observation, the ratios of ferrite, bainite, and pearlite are measured by a point counting method, and determined by calculation of area ratio of ferrite=(100−area ratio of hard second phase)×ferrite fraction/(ferrite fraction+bainite fraction+pearlite fraction).

The average particle size of the precipitated carbides present in ferrite was measured in the following manner: the precipitates are extracted by an extraction replica method; in the ferrite region, at a magnification (150000 times), a 1 μm×1 μm region is observed and photographed by a transmission electron microscope; then, the precipitates observed therein (2 nm or more in circle equivalent diameter) is subjected to image analysis, thereby to determine the area of each particle, and the circle equivalent diameter is determined from the area, and the average value is calculated, and is set as the average particle size.

The total content of Ti, Nb, and V forming the precipitated carbides was determined by the extraction residue analysis method. The front and back surfaces of the steel sheet were ground by 0.2 mm per side. Then, the sample was immersed in an AA (acetylacetone) type electrolyte to perform electrolysis. After completion of electrolysis, the precipitates on the sample surface were ultrasonically peeled in methanol. The electrolyte and the ultrasonic peeling solution after electrolysis were filtrated by suction, thereby to collect the residues (precipitates). As the filter, there was used a membrane filter (pore size 0.1 μm) of polycarbonate as the material. The residues were heated with the filter to be ashed, and an alkali solvent was added thereto. The mixture was heated again, to melt the residues. Then, an acid and water were added thereto to dissolve the melt. Then, water was added thereto to achieve a constant volume. This was used as an analyte solution. Using an ICP emission spectroscopy, the V, Nb, and Ti contents in the analyte solution were measured. Then, from the measurement results and the electrolysis mass (difference in mass between before and after electrolysis), the total content of Ti, Nb, and V forming the precipitates in the sample was calculated.

The average particle size of bainite was measured in the following manner: in the SEM photograph after the nital corrosion, the entire region of bainite surrounded by ferrite is defined as one particle; and the area of the region is measured by image analysis, and determined in terms of circle equivalent diameter.

The average particle size of the hard second phase was measured in the following manner: the region identified as the hard second phase by the Lepera corrosion is subjected to image analysis, thereby to determine the circle equivalent diameter.

Then, the composition of components forming the present invention steel sheet will be described. Below, the units of the chemical components are all mass %.

[Composition of the Present Invention Steel Sheet]

C: 0.05 to 0.20%

C is a hardening element. An increase in C content results in a decrease in area ratio of ferrite. When the content is less than 0.05%, a necessary strength cannot be provided. When the content exceeds 0.20%, the area ratio of bainite or the hard second phase becomes too large. Thus, the TS-EL balance or the TS-EL-λ balance cannot be ensured. The content is preferably 0.06 to 0.15%.

Si: 2.0% or less

Si contributes to the improvement of the TS-EL balance or the TS-EL-λ balance as the ferrite solid solution hardening element, and also contributes to the improvement of the fatigue property. However, when the content exceeds 2.0%, ferrite is excessively hardened, resulting in a reduction of EL. Preferably, the content is 0.5 to 1.7%.

Mn: 1.0 to 2.5%

Mn is added as a deoxidizing element, and contributes to the improvement of the TS-EL balance or the TS-EL-λ balance by solid solution hardening. However, when the content is less than 1.0% deoxidization is insufficient. Accordingly, the TS-EL balance or the TS-EL-λ balance is deteriorated. When the content exceeds 2.5%, the quenching property becomes too high, resulting in a reduction of the area ratio of ferrite. Preferably, the content is 1.2 to 2.0%.

Al: 0.001 to 0.10%

Al produces an effect of improving the TS-EL balance by solid solution hardening. However, when the content is less than the lower limit value, the effect cannot be obtained. When the content exceeds the upper limit value, grain boundary segregation occurs, which promotes intergranular fracture, resulting in a reduction of the TS-EL balance.

V: 0.0005 to 0.10%

Together with the following Ti and Nb, fine carbides are formed in ferrite. As a result, the fatigue property of the base material is improved. Further, at the HAZ, incorporation in solid solution is caused during heating by welding, thereby to inhibit the refinement of austenite particles. In addition, the solute C content and the solute V content are increased, thereby to improve the quenching property of the HAZ. As a result, the strength is enhanced, thereby to improve even the fatigue property of the HAZ. For this reason, V is an essential additive element. Preferably, the content is 0.002 to 0.08%.

Ti: 0.02 to 0.20%, and/or Nb: 0.02 to 0.20%

Ti and Nb form, as with V, fine carbides in ferrite thereby to improve the fatigue property of the base material. However, when respective contents are less than the lower limit value, the precipitation hardening effect is insufficient. Even addition in an amount of more than the upper limit value cannot produce the characteristic improving effect. Ti and Nb are selective additive elements as distinct from the V, and any one or both thereof are added and used. Ti and Nb are each added in an amount of preferably 0.03% or more, and further preferably 0.05% or more. Whereas, the preferable upper limit is 0.15%.

$$C-12\times(V/51+Ti/48+Nb/93)>0.03 \qquad \text{Expression (1)}$$

This expression means that the content of free C not fixed by V, Nb, or Ti is left in an amount of more than 0.03%. The free C contributes to ensuring of the necessary area ratio of bainite and the hard second phase. The calculated value (which is referred to as a component parameter) on the left side is preferably 0.05% or more. Incidentally, the symbol of element in the expression means the mass % of the element.

The present invention steel basically includes the components, and the balance substantially including iron and inevitable impurities. The inevitable impurities include P, S, N, O, and the like. Other than these, the following allowable components may be added within such a range as not to impair the advantageous effects of the present invention.

One or more of Cu: 0.01 to 1.0%, Ni: 0.01 to 1.0%, Cr: 0.01 to 1.0%, and Mo: 0.01 to 1.0%

The elements produce the effect of enhancing the quenching property of the steel, and thereby inhibiting the formation of other microstructures than martensite and retained austenite, and are added, if required. However, when the content is less than the lower limit value, the effect cannot be obtained. When the content exceeds the upper limit value, ferrite is embrittled, resulting in a reduction of the TS-EL balance or the TS-EL-λ balance. Each is preferably added in an amount of 0.1% or more. Further, the preferable upper limit is 0.8%, and the more preferable upper limit is 0.5%.

Then, a description will be given to a preferable manufacturing method for obtaining the present invention steel sheet below.

[Preferable Manufacturing Method of the Present Invention Steel Sheet]

The present invention steel sheet is manufactured in the following manner: the steel satisfying the composition is heated; then, hot rolling including finish rolling, rapid cooling after hot rolling, moderate cooling after stop of rapid cooling, rapid cooling after moderate cooling, and coiling are performed.

[Heating]

Heating before hot rolling is performed at 1050 to 1300° C. By the heating, the austenite single phase is achieved, and V, Ti, and Nb are incorporated in solid solution in austenite. When the heating temperature is less than 1050° C., V, Ti, and Nb cannot be incorporated in solid solution in austenite, so that coarse carbides are formed. Accordingly, the fatigue property improving effect cannot be provided. On the other hand, a temperature of more than 1300° C. is difficult in terms of the operation. The preferable lower limit of the heating temperature is 1100° C., and the further preferable lower limit is 1150° C.

[Hot Rolling]

Hot rolling is performed so that the finish rolling temperature is 880° C. or more. When the finish rolling temperature is set too low, ferrite transformation occurs at high temperatures. Accordingly, the precipitated carbides in ferrite are coarsened. For this reason, a given finish rolling temperature or higher is necessary. The finish rolling temperature is more preferably set at 900° C. or more in order to coarsen austenite particles, and to increase the particle size of bainite. Incidentally, the upper limit of the finish rolling temperature is set at 1000° C. because the temperature is difficult to ensure.

[Rapid Cooling after Hot Rolling]

After completion of the finish rolling, rapid cooling is performed at a cooling rate (first rapid cooling rate) of 20° C./s or more, and rapid cooling is stopped at a temperature (rapid cooling stop temperature) of 580° C. or more and less than 670° C. This is for the following purpose: the ferrite transformation start temperature is reduced, thereby to refine the precipitated carbides formed in ferrite. When the cooling rate (first rapid cooling rate) is less than 20° C./s, the pearlite transformation is promoted. Alternatively, when the rapid cooling stop temperature is less than 580° C., the pearlite transformation or the bainite transformation is promoted. In all cases, it becomes difficult to obtain a steel of the prescribed phase fraction, resulting in a reduction of the TS-EL balance or the TS-EL-λ balance. On the other hand, when the rapid cooling stop temperature is 670° C. or more, the precipitated carbides in ferrite are coarsened. Accordingly, the fatigue property of the HAZ cannot be ensured. The rapid cooling stop temperature is preferably 600 to 650° C., and further preferably 610 to 640° C.

[Moderate Cooling after Stopping Rapid Cooling]

After stop of the rapid cooling, by being allowed to cool or air cooling, moderate cooling is performed for 5 to 20 s at a cooling rate (moderate cooling rate) of 10° C./s or less. As a result, while allowing the formation of ferrite to sufficiently proceed, the precipitated carbides in ferrite are moderately refined. When the cooling rate exceeds 10° C./s, or the moderate cooling time is less than 5 s, the amount of ferrite formed is insufficient. On the other hand, when the moderate cooling time exceeds 20 s, the precipitated carbides are not coarsened. Accordingly, the fatigue property of the HAZ cannot be ensured.

[Rapid Cooling after Moderate Cooling and Coiling]

After the moderate cooling, rapid cooling is performed again at a cooling rate (second rapid cooling rate) of 20° C./s or more.

When an importance is placed on the balance among strength-elongation-stretch flange formability, and the balance other than ferrite is formed of a microstructure mainly including bainite, coiling is performed at more than 300° C. and 450° C. or less. When the cooling rate (second rapid cooling rate) is less than 20° C./s, or when the coiling temperature is more than 450° C., pearlite is formed. On the other hand, when the coiling temperature is less than 300° C., martensite or retained austenite is formed in a large quantity, resulting in a reduction of the balance among strength-elongation-stretch flange formability.

When an importance is placed on the further improvement of the balance between strength-elongation, and the balance other than ferrite is formed of a microstructure mainly including the hard second phase, coiling is performed at 300° C. or less. When the cooling rate (second rapid cooling rate) is less than 20° C./s, or the coiling temperature is more than 300° C., other microstructures than martensite and retained austenite are formed, resulting in a reduction of the balance between strength-elongation.

EXAMPLES

In order to verify the effects of the present invention, high strength hot-rolled steel sheets manufactured by variously changing the composition and the hot rolling conditions were examined for the effects exerted on the mechanical properties of the base material and the HAZ. Below, a description will be successively given to the case where the principal object is to achieve the balance other than ferrite formed of a microstructure mainly including bainite as Example 1, and the case where the principal object is to achieve the balance other than ferrite formed of a microstructure mainly including the hard second phase as Example 2.

Example 1

A sample steel formed of each composition shown in Table 1 below was vacuum melted, resulting in a sample with a gage of 30 mm. The sample was subjected to hot rolling by the process shown in FIG. 1, and under the conditions shown in Table 2 below, thereby to manufacture a hot-rolled steel sheet. More particularly, the sample was held at a heating temperature HT for 30 min. Then, finish rolling was performed at a finish rolling temperature FDT. As a result, the finish gage was set at 3 mm. After finish rolling, the sample was cooled to the rapid cooling stop temperature Tm at a first rapid cooling rate RCR1, and was allowed to cool for only the cooling time (moderate cooling time) tm. Incidentally, the cooling rate (moderate cooling rate) MCR during cooling was 10° C./s or less. Then, the sample was cooled to a coiling temperature CT at a second rapid cooling rate RCR2, and was held for 30 min, and then, was subjected to furnace cooling.

Each hot-rolled steel sheet (equivalent to the base material) thus obtained was measured for the area ratio of each phase, the average particle size of the precipitated carbides present in ferrite, the total content of Ti, Nb, and V forming the precipitated carbides, and the average particle size of bainite by the measuring methods described in the item of the "Description of Embodiments".

Further, the front and back sides were ground from the hot-rolled steel sheet equivalent to the base material, resulting in a sheet sample with a gage of 2 mm. Further, a tensile test was performed according to JIS Z2241, thereby to measure the tensile strength (TS) and the elongation (EL) of the base material.

Further, the front and back sides were ground from the hot-rolled steel sheet equivalent to the base material, resulting in a sheet sample with a gage of 2 mm. Further, a bore-expanding test was performed according to Japanese Steel Standard JFST001, thereby to measure the bore expanding ratio. This was referred to as the stretch flange formability (λ) of the base material.

Still further, the front and back surfaces of the hot-rolled steel sheet equivalent to the base material were ground by 0.2 mm per side. Then, by the plane bending test according to JIS Z2275, a S—N curve was formed, thereby to determine the fatigue limit. This was referred to as the fatigue strength of the base material. Further, the fatigue limit ratio (FL/TS) was calculated from the fatigue strength (FL) and the tensile strength (TS) of the base material.

Then, in order to simulate the fine grain region of the HAZ, the hot-rolled steel sheet equivalent to the base material was heated up to 950° C. at a heating rate of 30° C./s by a heat treatment simulator. Then, immediately, the sample was cooled to room temperature at a cooling rate of 30° C./s, resulting in a fine grain region simulated material.

Whereas, in order to simulate the tempered region of the HAZ, the hot-rolled steel sheet equivalent to the base material was heated up to 700° C. at a heating rate of 30° C./s by a heat treatment simulator. Then, immediately, the sample was cooled to room temperature at a cooling rate of 30° C./s, resulting in a tempered region simulated material.

Then, the fine grain region simulated material and the tempered region simulated material were subjected to the fatigue test as with the hot-rolled steel sheet equivalent to the base material. However, there was no fatigue limit. For this reason, the time strength such that the sample is unfractured upon undergoing the test $2\times10^6$ times is referred to as the fatigue strength.

The measurement results are shown in Table 3.

TABLE 1

| Steel grade sign | Component (mass %) | | | | | | | | | | | |
|---|---|---|---|---|---|---|---|---|---|---|---|---|
| | C | Si | Mn | P | S | Al | N | V | Ti | Nb | Others | C − 12 × (V/51 + Ti/48 + Nb/93) |
| 1A | 0.18 | 0.50 | 1.20 | 0.005 | 0.002 | 0.030 | 0.003 | 0.02 | 0.07 | — | — | 0.158 |
| 1B | 0.09 | 0.90 | 1.50 | 0.005 | 0.002 | 0.030 | 0.003 | 0.05 | 0.10 | — | — | 0.053 |
| 1C | 0.12 | 1.10 | 1.50 | 0.005 | 0.002 | 0.030 | 0.003 | 0.07 | 0.08 | 0.03 | — | 0.080 |
| 1D | 0.08 | 1.50 | 1.80 | 0.005 | 0.002 | 0.030 | 0.003 | 0.05 | 0.08 | — | — | 0.048 |
| 1E | 0.11 | 1.00 | 1.50 | 0.005 | 0.002 | 0.030 | 0.003 | 0.05 | — | 0.09 | — | 0.087 |
| 1F | 0.07 | 1.80 | 1.10 | 0.005 | 0.002 | 0.030 | 0.003 | 0.01 | 0.08 | — | — | 0.048 |
| 1G* | 0.25* | 1.00 | 1.50 | 0.005 | 0.002 | 0.030 | 0.003 | 0.05 | 0.10 | — | — | 0.213 |
| 1H* | 0.06 | 1.20 | 1.50 | 0.005 | 0.002 | 0.030 | 0.003 | —* | 0.10 | — | — | 0.035 |
| 1I* | 0.07 | 1.20 | 1.50 | 0.005 | 0.002 | 0.030 | 0.003 | —* | — | 0.10 | — | 0.057 |
| 1J* | 0.06 | 1.20 | 1.50 | 0.005 | 0.002 | 0.030 | 0.003 | 0.10 | —* | —* | — | 0.036 |
| 1K | 0.06 | 1.20 | 1.50 | 0.005 | 0.002 | 0.030 | 0.003 | 0.07 | 0.05 | — | — | 0.031 |
| 1L* | 0.06 | 1.20 | 1.50 | 0.005 | 0.002 | 0.030 | 0.003 | 0.09 | 0.15 | — | — | 0.001* |
| 1M* | 0.06 | 1.20 | 3.00* | 0.005 | 0.002 | 0.030 | 0.003 | 0.03 | 0.07 | — | — | 0.035 |
| 1N* | 0.06 | 1.20 | 0.50* | 0.005 | 0.002 | 0.030 | 0.003 | 0.03 | 0.07 | — | — | 0.035 |
| 1O | 0.10 | 1.00 | 1.50 | 0.005 | 0.002 | 0.030 | 0.003 | 0.03 | 0.07 | — | — | 0.075 |
| 1P | 0.10 | 1.00 | 1.50 | 0.005 | 0.002 | 0.030 | 0.003 | 0.03 | 0.07 | — | Cu: 0.20 | 0.075 |
| 1Q | 0.10 | 1.00 | 1.50 | 0.005 | 0.002 | 0.030 | 0.003 | 0.03 | 0.07 | — | Ni: 0.20 | 0.075 |
| 1R | 0.10 | 1.00 | 1.50 | 0.005 | 0.002 | 0.030 | 0.003 | 0.03 | 0.07 | — | Cr: 0.20 | 0.075 |
| 1S | 0.10 | 1.00 | 1.50 | 0.005 | 0.002 | 0.030 | 0.003 | 0.03 | 0.07 | — | Mo: 0.20 | 0.075 |

*Outside the range of the present invention

TABLE 2

| Hot-rolled No. | Heating temperature HT (° C.) | Finish rolling temperature FDT (° C.) | First rapid cooling rate RCR1 (° C./s) | Rapid cooling stop temperature Tm (° C.) | Cooling time tm (s) | Second rapid cooling rate RCR2 (° C./s) | Coiling temperature CT (° C.) |
|---|---|---|---|---|---|---|---|
| 1a | 1180 | 950 | 50 | 625 | 5 | 50 | 400 |
| 1b | 1180 | 890 | 50 | 625 | 5 | 50 | 400 |
| 1c | 1180 | 950 | 50 | 590 | 5 | 50 | 400 |
| 1d# | 1180 | 950 | 50 | 500# | 5 | 50 | 400 |
| 1e# | 1180 | 950 | 50 | 680# | 5 | 50 | 400 |
| 1f | 1180 | 950 | 50 | 625 | 12 | 50 | 400 |
| 1g# | 1180 | 950 | 50 | 625 | 60# | 50 | 400 |
| 1h# | 1180 | 950 | 50 | 625 | 5 | 50 | 200# |

(#= Outside the recommended range)

TABLE 3

| | | | Microstructure | | | | | | Mechanical properties | | | | | | | |
|---|---|---|---|---|---|---|---|---|---|---|---|---|---|---|---|---|
| | | | | | | Precipitated carbides | | Bainite | Base material | | | | | HAZ | | |
| Steel No. | Steel grade sign | Hot-rolled No. | Area ratio (%) Ferrite | Area ratio (%) Bainite | Area ratio (%) Others | Average particle size (nm) | (V + Ti + Nb) content (mass %) | average particle size (μm) | TS (MPa) | EL (%) | λ (%) | FL (MPa) | FL/TS (—) | Fine grain region FL (MPa) | Tempered region FL (MPa) | Evaluation |
| 1 | 1A | 1a | 70 | 30 | — | 4.6 | 0.07 | 9.6 | 899 | 20.3 | 85.6 | 536 | 0.60 | 320 | 325 | ○ |
| 2 | 1B | 1a | 75 | 25 | — | 4.2 | 0.11 | 8.5 | 900 | 20.1 | 80.2 | 525 | 0.58 | 319 | 341 | ○ |
| 3 | 1C | 1a | 78 | 22 | — | 4.3 | 0.14 | 8.8 | 888 | 20.9 | 83.2 | 512 | 0.58 | 326 | 317 | ○ |
| 4 | 1D | 1a | 87 | 13 | — | 4.1 | 0.10 | 9.5 | 810 | 20.1 | 85.5 | 483 | 0.60 | 318 | 321 | ○ |
| 5 | 1E | 1a | 82 | 18 | — | 3.9 | 0.10 | 9.7 | 846 | 20.3 | 82.4 | 507 | 0.60 | 323 | 314 | ○ |
| 6 | 1F | 1a | 83 | 13 | MA: 4 | 4.0 | 0.07 | 8.6 | 781 | 20.1 | 76.9 | 454 | 0.58 | 336 | 319 | ○ |
| 7 | 1G* | 1a | 52 | 48 | — | 4.6 | 0.11 | 9.0 | 1057 | 17.3* | 86.1 | 507 | 0.48* | 315 | 349 | x |
| 8 | 1H* | 1a | 82 | 18 | — | 4.4 | 0.08 | 8.5 | 837 | 20.8 | 87.5 | 481 | 0.57 | 260* | 338 | x |
| 9 | 1I* | 1a | 79 | 21 | — | 4.4 | 0.08 | 8.9 | 858 | 20.6 | 84.5 | 485 | 0.57 | 267* | 317 | x |
| 10 | 1J* | 1a | 82 | 18 | — | 5.3 | 0.01* | 9.9 | 680* | 21.0 | 82.8 | 325* | 0.48 | 278* | 234* | x |
| 11 | 1K | 1a | 88 | 12 | — | 4.5 | 0.10 | 9.1 | 786 | 20.1 | 82.6 | 469 | 0.60 | 320 | 315 | ○ |
| 12 | 1L* | 1a | 97* | 3* | — | 4.2 | 0.17 | 6.7 | 635* | 25.8 | 83.5 | 349* | 0.55 | 318 | 347 | x |
| 13 | 1M* | 1a | 30* | 70 | — | 4.2 | 0.08 | 10.2 | 1050 | 9.8* | 82.8 | 480 | 0.46* | 346 | 327 | x |
| 14 | 1N* | 1a | 83 | —* | Pearlite: 17* | 4.0 | 0.08 | — | 605* | 28.5 | 81.1 | 348* | 0.58 | 329 | 274* | x |
| 15 | 1O | 1a | 81 | 19 | — | 4.4 | 0.07 | 8.9 | 821 | 20.2 | 87.2 | 464 | 0.56 | 315 | 314 | ○ |
| 16 | 1O | 1b | 81 | 19 | — | 4.7 | 0.07 | 5.9 | 822 | 20.8 | 81.5 | 485 | 0.59 | 302 | 324 | ○ |
| 17 | 1O | 1c | 81 | 19 | — | 2.9 | 0.08 | 8.4 | 824 | 20.3 | 83.8 | 470 | 0.57 | 342 | 315 | ○ |
| 18 | 1O | 1d# | 11* | 15 | Pearlite: 74* | 2.9 | 0.08 | 11.2 | 983 | 13.7* | 83.9 | 564 | 0.57 | 316 | 315 | x |
| 19 | 1O | 1e# | 81 | 19 | — | 9.3* | 0.08 | 9.3 | 824 | 20.5 | 84.0 | 552 | 0.67 | 293* | 326 | x |
| 20 | 1O | F | 83 | 17 | — | 5.2 | 0.07 | 8.7 | 808 | 20.3 | 85.3 | 459 | 0.57 | 324 | 333 | ○ |
| 21 | 1O | 1g# | 82 | 18 | — | 8.7* | 0.07 | 9.6 | 815 | 20.2 | 80.2 | 538 | 0.66 | 275* | 335 | x |
| 22 | 1O | 1h# | 81 | —* | MA: 19* | 4.3 | 0.08 | — | 835 | 20.7 | 60.8* | 501 | 0.60 | 323 | 320 | x |
| 23 | 1P | 1a | 82 | 18 | — | 4.1 | 0.07 | 8.4 | 815 | 20.9 | 84.2 | 500 | 0.61 | 376 | 332 | ○ |
| 24 | 1Q | 1a | 82 | 18 | — | 3.9 | 0.07 | 9.2 | 815 | 20.2 | 87.3 | 499 | 0.61 | 330 | 335 | ○ |
| 25 | 1R | 1a | 82 | 18 | — | 3.5 | 0.08 | 9.0 | 817 | 20.5 | 83.1 | 501 | 0.61 | 327 | 330 | ○ |
| 26 | 1S | 1a | 82 | 18 | — | 4.6 | 0.07 | 8.6 | 814 | 20.5 | 86.9 | 505 | 0.62 | 332 | 333 | ○ |

(*= Outside the range of the present invention, #= Outside the recommended range,
○: Base material [TS ≥ 750 MPa and EL ≥ 18% and λ ≥ 70% and FL ≥ 430 MPa and FL/TS ≥ 0.50] and HAZ [Fine grain part FL ≥ 300 MPa and tempered part FL ≥ 300 MPa]
x: Case where the conditions of the ○ are not satisfied)

As shown in the tables, for all the steels Nos. 1 to 6, 11, 15 to 17, 20, and 23 to 26 which are the present invention steel sheets, there were used steel grades satisfying the range of the composition of the present invention. Thus, the steels were manufactured under the recommended hot rolling conditions. As a result, the steels satisfy all the essential requirements of the microstructure regulation of the present invention. This resulted in high-strength hot-rolled steel sheets having even the fatigue properties of the base material and the HAZ, while ensuring the balance among strength-elongation-stretch flange formability of the base material.

In contrast, for all the steels Nos. 7 to 10, and 12 to 14, which are comparative steels, there were used steel grades not satisfying the requirements of the composition regulated in the present invention. For this reason, although the steels were manufactured under the recommended hot rolling conditions, the steels were inferior in at least any characteristic of the balance among strength-elongation-stretch flange formability of the base material, and the fatigue properties of the base material and the HAZ.

Whereas, for all the steels Nos. 18, 19, 21, and 22, which are other comparative steels, there were used steel grades satisfying the range of the composition of the present invention. However, the steels were manufactured under the conditions outside the recommended hot rolling conditions. As a result, the steels did not satisfy the requirements of the microstructure of the present invention. The steels were still inferior in at least any characteristic of the balance among strength-elongation-stretch flange formability of the base material, and the fatigue properties of the base material and the HAZ. Incidentally, the steel No. 22 can be said to be a comparative steel in the case of the present Example 1 where the principal object is to achieve the balance other than ferrite formed of a microstructure mainly including bainite, namely, in the case where the object is to achieve the balance among strength-elongation-stretch flange formability of the base material. However, the steel satisfies the conditions of claim 1 of the present application, and is excellent in the balance between strength-elongation of the base material.

Example 2

A sample steel formed of each composition shown in Table 4 below was vacuum melted, resulting in a sample with a gage of 30 mm. The sample was subjected to hot rolling by the process shown in FIG. 1, and under the conditions shown in Table 5 below, thereby to manufacture a hot-rolled steel sheet. More particularly, the sample was held at a heating temperature HT for 30 min. Then, finish rolling was performed at a finish rolling temperature FDT. As a result, the finish gage was set at 3 mm. After finish rolling, the sample was cooled to the rapid cooling stop temperature Tm at the first rapid cooling rate RCR1, and was allowed to cool for only the cooling time (moderate cooling time) tm. Incidentally, the cooling rate (moderate cooling rate) MCR during cooling was 10° C./s or less. Then, the sample was cooled to the coiling temperature CT at the second rapid cooling rate RCR2, and was held for 30 min, and then, was subjected to furnace cooling.

Each hot-rolled steel sheet (equivalent to the base material) thus obtained was measured for the area ratio of each phase, the average particle size of the precipitated carbides present in ferrite, the total content of Ti, Nb, and V forming the precipitated carbides, and the average particle size of the hard second phase by the measuring methods described in the item of the "Description of Embodiments".

Further, the front and back sides were ground from the hot-rolled steel sheet equivalent to the base material, resulting in a sheet sample with a gage of 2 mm. Further, a tensile test was performed according to JIS Z2241, thereby to measure the tensile strength (TS) and the elongation (EL) of the base material.

Further, the front and back surfaces of the hot-rolled steel sheet equivalent to the base material were ground by 0.2 mm per side. Then, by the plane bending test according to JIS Z2275, a S—N curve was formed, thereby to determine the fatigue limit. This was referred to as the fatigue strength of the base material. Further, the fatigue limit ratio (FL/TS) was calculated from the fatigue strength (FL) and the tensile strength (TS) of the base material.

Then, in order to simulate the fine grain region of the HAZ, the hot-rolled steel sheet equivalent to the base material was heated up to 950° C. at a heating rate of 30° C./s by a heat treatment simulator. Then, immediately, the sample was cooled to room temperature at a cooling rate of 30° C./s, resulting in a fine grain region simulated material.

Whereas, in order to simulate the tempered region of the HAZ, the hot-rolled steel sheet equivalent to the base material was heated up to 700° C. at a heating rate of 30° C./s by a heat treatment simulator. Then, immediately, the sample was cooled to room temperature at a cooling rate of 30° C./s, resulting in a tempered region simulated material.

Then, the fine grain region simulated material and the tempered region simulated material were subjected to the fatigue test as with the hot-rolled steel sheet equivalent to the base material. However, there was no fatigue limit. For this reason, the time strength such that the sample is unfractured upon undergoing the test $2\times10^6$ times was referred to as the fatigue strength.

The measurement results are shown in Table 6.

TABLE 4

| Steel grade sign | Component (mass %) | | | | | | | | | | | |
|---|---|---|---|---|---|---|---|---|---|---|---|---|
| | C | Si | Mn | P | S | Al | N | V | Ti | Nb | Others | C − 12 × (V/51 + Ti/48 + Nb/93) |
| 2A | 0.18 | 0.50 | 1.20 | 0.005 | 0.002 | 0.030 | 0.003 | 0.02 | 0.07 | — | — | 0.158 |
| 2B | 0.09 | 0.90 | 1.50 | 0.005 | 0.002 | 0.030 | 0.003 | 0.05 | 0.10 | — | — | 0.053 |
| 2C | 0.12 | 1.10 | 1.50 | 0.005 | 0.002 | 0.030 | 0.003 | 0.07 | 0.08 | 0.03 | — | 0.080 |
| 2D | 0.08 | 1.50 | 1.80 | 0.005 | 0.002 | 0.030 | 0.003 | 0.05 | 0.08 | — | — | 0.048 |
| 2E | 0.11 | 1.00 | 1.50 | 0.005 | 0.002 | 0.030 | 0.003 | 0.05 | — | 0.09 | — | 0.087 |
| 2F | 0.07 | 1.80 | 1.10 | 0.005 | 0.002 | 0.030 | 0.003 | 0.01 | 0.08 | — | — | 0.048 |
| 2G* | 0.25* | 1.00 | 1.50 | 0.005 | 0.002 | 0.030 | 0.003 | 0.05 | 0.10 | — | — | 0.213 |
| 2H* | 0.06 | 1.20 | 1.50 | 0.005 | 0.002 | 0.030 | 0.003 | —* | 0.10 | — | — | 0.035 |
| 2I* | 0.07 | 1.20 | 1.50 | 0.005 | 0.002 | 0.030 | 0.003 | —* | — | 0.10 | — | 0.057 |
| 2J* | 0.06 | 1.20 | 1.50 | 0.005 | 0.002 | 0.030 | 0.003 | 0.10 | —* | —* | — | 0.036 |
| 2K | 0.06 | 1.20 | 1.50 | 0.005 | 0.002 | 0.030 | 0.003 | 0.07 | 0.05 | — | — | 0.031 |
| 2L* | 0.06 | 1.20 | 1.50 | 0.005 | 0.002 | 0.030 | 0.003 | 0.09 | 0.15 | — | — | 0.001* |
| 2M* | 0.06 | 1.20 | 3.00* | 0.005 | 0.002 | 0.030 | 0.003 | 0.03 | 0.07 | — | — | 0.035 |
| 2N* | 0.06 | 1.20 | 0.50* | 0.005 | 0.002 | 0.030 | 0.003 | 0.03 | 0.07 | — | — | 0.035 |
| 2O | 0.10 | 1.00 | 1.50 | 0.005 | 0.002 | 0.030 | 0.003 | 0.03 | 0.07 | — | — | 0.075 |
| 2P | 0.10 | 1.00 | 1.50 | 0.005 | 0.002 | 0.030 | 0.003 | 0.03 | 0.07 | — | Cu: 0.20 | 0.075 |
| 2Q | 0.10 | 1.00 | 1.50 | 0.005 | 0.002 | 0.030 | 0.003 | 0.03 | 0.07 | — | Ni: 0.20 | 0.075 |
| 2R | 0.10 | 1.00 | 1.50 | 0.005 | 0.002 | 0.030 | 0.003 | 0.03 | 0.07 | — | Cr: 0.20 | 0.075 |
| 2S | 0.10 | 1.00 | 1.50 | 0.005 | 0.002 | 0.030 | 0.003 | 0.03 | 0.07 | — | Mo: 0.20 | 0.075 |

(*= Outside the range of the present invention)

TABLE 5

| Hot-rolled No. | Heating temperature HT (° C.) | Finish rolling temperature FDT (° C.) | First rapid cooling rate RCR1 (° C./s) | Rapid cooling stop temperature Tm (° C.) | Cooling time tm (s) | Second rapid cooling rate RCR2 (° C./s) | Coiling temperature CT (° C.) |
|---|---|---|---|---|---|---|---|
| 2a | 1180 | 950 | 50 | 625 | 5 | 50 | 200 |
| 2b | 1180 | 890 | 50 | 625 | 5 | 50 | 200 |
| 2c | 1180 | 950 | 50 | 590 | 5 | 50 | 200 |
| 2d# | 1180 | 950 | 50 | 500# | 5 | 50 | 200 |
| 2e# | 1180 | 950 | 50 | 680# | 5 | 50 | 200 |
| 2f | 1180 | 950 | 50 | 625 | 12 | 50 | 200 |
| 2g# | 1180 | 950 | 50 | 625 | 60# | 50 | 200 |
| 2h# | 1180 | 950 | 50 | 625 | 5 | 50 | 400# |

(#= Outside the recommended range)

TABLE 6

| | | | Microstructure | | | | | | Mechanical properties | | | | | | |
|---|---|---|---|---|---|---|---|---|---|---|---|---|---|---|---|
| | | | Area ratio (%) | | | Precipitated carbides | | Hard second phase | Base material | | | | HAZ | | |
| Steel No. | Steel grade sign | Hot-rolled No. | Fer-rite | Hard second phase | Others | Average particle size (nm) | (V + Ti + Nb) content (mass %) | average particle size (μm) | TS (MPa) | EL (%) | FL (MPa) | FL/TS (—) | Fine grain region FL (MPa) | Tempered region FL (MPa) | Evaluation |
| 27 | 2A | 2a | 75 | 25 | — | 4.6 | 0.07 | 10.0 | 882 | 25.9 | 500 | 0.57 | 321 | 325 | ○ |
| 28 | 2B | 2a | 80 | 20 | — | 4.6 | 0.11 | 8.1 | 864 | 25.7 | 499 | 0.58 | 323 | 343 | ○ |
| 29 | 2C | 2a | 82 | 18 | — | 4.8 | 0.13 | 8.8 | 859 | 25.6 | 499 | 0.58 | 327 | 325 | ○ |
| 30 | 2D | 2a | 92 | 8 | — | 4.0 | 0.09 | 8.6 | 772 | 22.7 | 444 | 0.57 | 324 | 321 | ○ |
| 31 | 2E | 2a | 84 | 16 | — | 4.5 | 0.11 | 9.8 | 835 | 25.7 | 499 | 0.60 | 328 | 311 | ○ |
| 32 | 2F | 2a | 87 | 13 | — | 4.3 | 0.07 | 8.4 | 798 | 24.3 | 458 | 0.57 | 327 | 326 | ○ |
| 33 | 2G* | 2a | 55 | 45 | — | 4.5 | 0.11 | 9.7 | 1038 | 16.8* | 498 | 0.48* | 323 | 343 | x |
| 34 | 2H* | 2a | 85 | 15 | — | 4.6 | 0.08 | 8.9 | 814 | 24.2 | 485 | 0.60 | 263* | 346 | x |
| 35 | 2I* | 2a | 82 | 18 | — | 4.6 | 0.07 | 8.1 | 834 | 25.2 | 491 | 0.59 | 272* | 321 | x |
| 36 | 2J* | 2a | 85 | 15 | — | 5.8 | 0.01* | 8.4 | 703* | 24.3 | 340* | 0.48* | 280* | 241* | x |
| 37 | 2K | 2a | 92 | 8 | — | 4.2 | 0.09 | 9.8 | 786 | 22.1 | 460 | 0.59 | 323 | 312 | ○ |
| 38 | 2L* | 2a | 98* | 2 | — | 4.0 | 0.19 | 9.6 | 650* | 25.0 | 358* | 0.55 | 326 | 348 | x |
| 39 | 2M* | 2a | 35* | 25 | Bainite: 40* | 4.5 | 0.08 | 9.9 | 1173 | 9.5* | 420* | 0.36* | 341 | 325 | x |
| 40 | 2N* | 2a | 87 | — | Pearlite: 13* | 4.1 | 0.08 | 9.6 | 645* | 28.0 | 376* | 0.58 | 326 | 273* | x |
| 41 | 2O | 2a | 85 | 15 | — | 4.3 | 0.07 | 8.9 | 814 | 24.5 | 453 | 0.56 | 325 | 320 | ○ |
| 42 | 2O | 2b | 85 | 15 | — | 4.9 | 0.08 | 4.2# | 816 | 24.6 | 455 | 0.56 | 305 | 324 | ○ |
| 43 | 2O | 2c | 85 | 15 | — | 3.0 | 0.08 | 8.3 | 814 | 24.7 | 464 | 0.57 | 333 | 321 | ○ |
| 44 | 2O | 2d# | 15* | 15 | Bainite: 70* | 3.3 | 0.07 | 3.2# | 983 | 12.9* | 587 | 0.60 | 325 | 322 | x |
| 45 | 2O | 2e# | 85 | 15 | — | 9.6* | 0.07 | 8.2 | 813 | 24.1 | 545 | 0.67 | 285* | 323 | x |
| 46 | 2O | 2f | 85 | 15 | — | 5.2 | 0.08 | 9.6 | 816 | 24.2 | 485 | 0.59 | 325 | 328 | ○ |
| 47 | 2O | 2g# | 85 | 15 | — | 8.8* | 0.07 | 9.2 | 813 | 24.5 | 537 | 0.66 | 284* | 327 | x |
| 48 | 2O | 2h# | 85 | — | Bainite: 15* | 4.7 | 0.07 | 8.4 | 782 | 18.9* | 469 | 0.60 | 325 | 324 | x |
| 49 | 2P | 2a | 85 | 15 | — | 4.3 | 0.08 | 9.9 | 815 | 24.1 | 500 | 0.61 | 382 | 328 | ○ |
| 50 | 2Q | 2a | 85 | 15 | — | 4.5 | 0.07 | 8.3 | 812 | 24.7 | 497 | 0.61 | 328 | 335 | ○ |
| 51 | 2R | 2a | 85 | 15 | — | 4.0 | 0.08 | 9.2 | 815 | 24.1 | 500 | 0.61 | 325 | 338 | ○ |
| 52 | 2S | 2a | 85 | 15 | — | 4.4 | 0.08 | 8.2 | 817 | 24.8 | 507 | 0.62 | 325 | 339 | ○ |

(*= Outside the range of the present invention, #= Outside the recommended range,
○: Base material [TS ≥ 750 MPa and EL ≥ 21% and FL ≥ 430 MPa and FL/TS ≥ 0.50] and HAZ [Fine grain part FL ≥ 300 MPa and tempered part FL ≥ 300 MPa]
x: Case where the conditions of the ○ are not satisfied)

As shown in the tables, for all the steels Nos. 27 to 32, 37, 41 to 43, 46, and 49 to 53, which are the present invention steel sheet, there were used steel grades satisfying the range of the composition of the present invention. Thus, the steels were manufactured under the recommended hot rolling conditions. As a result, the steels satisfied all the essential requirements of the microstructure regulation of the present invention. This resulted in high-strength hot-rolled steel sheets having even the fatigue properties of the base material and the HAZ, while ensuring the balance between strength-elongation of the base material.

In contrast, for all the steels Nos. 33 to 36, and 38 to 40, there were used steel grades not satisfying the requirements of the composition regulated in the present invention. For this reason, although the steels were manufactured under the recommended hot rolling conditions, the steels were inferior in at least any characteristic of the balance between strength-elongation of the base material, and the fatigue properties of the base material and the HAZ.

Whereas, for all the steels Nos. 44, 45, 47, and 48, there were used steel grades satisfying the range of the composition of the present invention. However, the steels were manufactured under the conditions outside the recommended hot rolling conditions. As a result, the steels did not satisfy the requirements of the microstructure of the present invention. The steels were still inferior in at least any characteristic of the balance between strength-elongation of the base material, and the fatigue properties of the base material and the HAZ. Incidentally, the steel No. 48 can be said to be a comparative steel in the case of the present Example 2 where the principal object is to achieve the balance other than ferrite formed of a microstructure mainly including the hard second phase, namely, in the case where the object is to further improve the balance among strength-elongation-elongation of the base material. However, the steel satisfies the conditions of claim 1 of the present application, and exhibits an excellent balance between strength-elongation with a base material strength of 750 MPa or more, and an elongation of 18% or more.

The present invention was described particularly by way of specific embodiments. However, it is obvious to those skilled in the art that various changes and modifications may be added without departing from the spirit and the scope of the present invention.

This application is based on Japanese Patent Application No. 2011-178475 filed on Aug. 17, 2011, and Japanese Patent Application No. 2011-178476 filed on Aug. 17, 2011, the contents of which are hereby incorporated by reference.

INDUSTRIAL APPLICABILITY

The high-strength hot-rolled steel sheet of the present invention is suitable for components requiring strength, workability, and fatigue property such as automotive suspension and frame components.

The invention claimed is:

1. A high-strength hot-rolled steel sheet, comprising, by mass %:

C: 0.05 to 0.20%;
Si: 0.5 to 1.7%;
Mn: 1.0 to 2.5%;
Al: 0.001 to 0.10%;
V: 0.0005 to 0.10%; and
one component selected from the group consisting of Ti, Nb, and mixtures thereof, in the following amounts: Ti: 0.05 to 0.20%; Nb: 0.02 to 0.20%; and mixtures thereof comprising 0.05 to 0.20% Ti and 0.02 to 0.20% Nb;
with the remaining mass % comprising iron; and inevitable impurities;
wherein:
the steel sheet has a tensile strength of 786 MPa or more;
the steel sheet has a microstructure comprising, by area ratio based on the total microstructure:
ferrite: 50 to 90%;
bainite: 10 to 50%; and
martensite+retained austenite: less than 10%;
an average particle size of precipitated carbides present in the ferrite is less than 6 nm;
a total content of V, Ti, and Nb forming the precipitated carbides is 0.02% or more; and
the steel sheet satisfies the following Expression 1:

$$C-12\times(V/51+Ti/48+Nb/93)>0.03,$$

where element symbols in the Expression 1 correspond to mass %.

2. The steel sheet according to claim 1, wherein the microstructure in the steel sheet comprises, by area ratio based on the total microstructure:
ferrite: 60 to 80%;
bainite: 20 to 40%; and
martensite+retained austenite: less than 10%.

3. The steel sheet according to claim 1, wherein an average particle size of the bainite is more than 5 μm.

4. The steel sheet according to claim 1, further comprising in mass % one or more of:
Cu: 0.01 to 1.0%;
Ni: 0.01 to 1.0%;
Cr: 0.01 to 1.0%; and
Mo: 0.01 to 1.0%.

5. The steel sheet according to claim 2, further comprising in mass % one or more of:
Cu: 0.01 to 1.0%;
Ni: 0.01 to 1.0%;
Cr: 0.01 to 1.0%; and
Mo: 0.01 to 1.0%.

6. The steel sheet according to claim 3, further comprising in mass % one or more of:
Cu: 0.01 to 1.0%;
Ni: 0.01 to 1.0%;
Cr: 0.01 to 1.0%; and
Mo: 0.01 to 1.0%.

7. The steel sheet according to claim 1, wherein the Si content in the high-strength hot-rolled steel sheet is 0.9 to 1.7 mass %.

8. The steel sheet according to claim 1, wherein the Si content in the high-strength hot-rolled steel sheet is more than 0.5 to 1.7 mass %.

* * * * *